US007610994B2

(12) United States Patent
Green

(10) Patent No.: US 7,610,994 B2
(45) Date of Patent: Nov. 3, 2009

(54) ELEVATOR COMPENSATING CABLE HAVING A SELECTED LOOP RADIUS AND ASSOCIATED SYSTEM AND METHOD

(75) Inventor: Dillard Hairston Green, Rocky Mount, NC (US)

(73) Assignee: Draka Elevator Products, Rocky Mount, NC (US)

( * ) Notice: Subject to any disclaimer, the term of this patent is extended or adjusted under 35 U.S.C. 154(b) by 684 days.

(21) Appl. No.: 11/128,471

(22) Filed: May 13, 2005

(65) Prior Publication Data

US 2006/0254865 A1 Nov. 16, 2006

(51) Int. Cl.
*B66B 11/04* (2006.01)

(52) U.S. Cl. ..... 187/251; 428/375; 428/380

(58) Field of Classification Search ..... 187/251; 428/375, 380, 373, 383, 394
See application file for complete search history.

(56) References Cited

U.S. PATENT DOCUMENTS

| | | | | | |
|---|---|---|---|---|---|
| 3,653,467 | A * | 4/1972 | Showalter | 187/265 |
| 3,823,253 | A * | 7/1974 | Walters et al. | 174/69 |
| 3,882,968 | A * | 5/1975 | Suozzo | 187/264 |
| 3,896,905 | A | 7/1975 | Solymos | |
| 4,174,990 | A * | 11/1979 | Meister | 156/158 |
| 4,402,346 | A * | 9/1983 | Cheetham et al. | 138/129 |
| 4,664,229 | A | 5/1987 | Obst et al. | |
| 4,716,989 | A | 1/1988 | Coleman | |
| H000702 | H * | 11/1989 | Shively et al. | 187/405 |
| 5,320,904 | A * | 6/1994 | Mitchell | 428/378 |
| 5,644,105 | A * | 7/1997 | Castellani | 174/110 SR |
| 5,737,794 | A * | 4/1998 | Barber et al. | 15/229.12 |
| 5,834,942 | A * | 11/1998 | De Angelis | 324/522 |
| 5,843,942 | A * | 12/1998 | Breault et al. | 514/247 |
| 6,234,277 | B1 * | 5/2001 | Kaczmarek | 187/414 |
| 6,258,917 | B1 * | 7/2001 | Slagel | 528/64 |
| 6,318,504 | B1 * | 11/2001 | De Angelis | 187/254 |
| 6,352,471 | B1 * | 3/2002 | Bange et al. | 451/527 |
| 6,488,125 | B1 * | 12/2002 | Otsuka et al. | 187/264 |
| 6,532,471 | B1 * | 3/2003 | Ku et al. | 707/102 |
| 6,768,060 | B2 * | 7/2004 | Belli et al. | 174/110 F |
| 6,837,340 | B2 * | 1/2005 | Strauss et al. | 187/413 |
| 2002/0039653 | A1 * | 4/2002 | Castellani et al. | 428/375 |

(Continued)

FOREIGN PATENT DOCUMENTS

| | | |
|---|---|---|
| GB | 1 048 306 A | 11/1966 |

(Continued)

*Primary Examiner*—Patrick H Mackey
*Assistant Examiner*—Terrell H Matthews
(74) *Attorney, Agent, or Firm*—Alston & Bird LLP

(57) ABSTRACT

A compensating cable adapted to attach to an elevator car is provided, wherein the compensating cable includes two portions connected by an arcuate portion. The arcuate portion of the compensating cable defines a loop having an extended diameter such that the compensating cable is capable of attaching to a centerline of the elevator car. Thus, the weight force exerted by the compensating cable on the elevator car may be localized about the centerline such that the elevator car is substantially balanced about the centerline while in operation. In some instances, the compensating cable includes a selected structure and materials suitable for forming an arcuate portion having a suitable loop diameter for attaching the compensating cable to the centerline of the elevator car. An associated system and method are also provided.

1 Claim, 2 Drawing Sheets

U.S. PATENT DOCUMENTS

Figure 1:
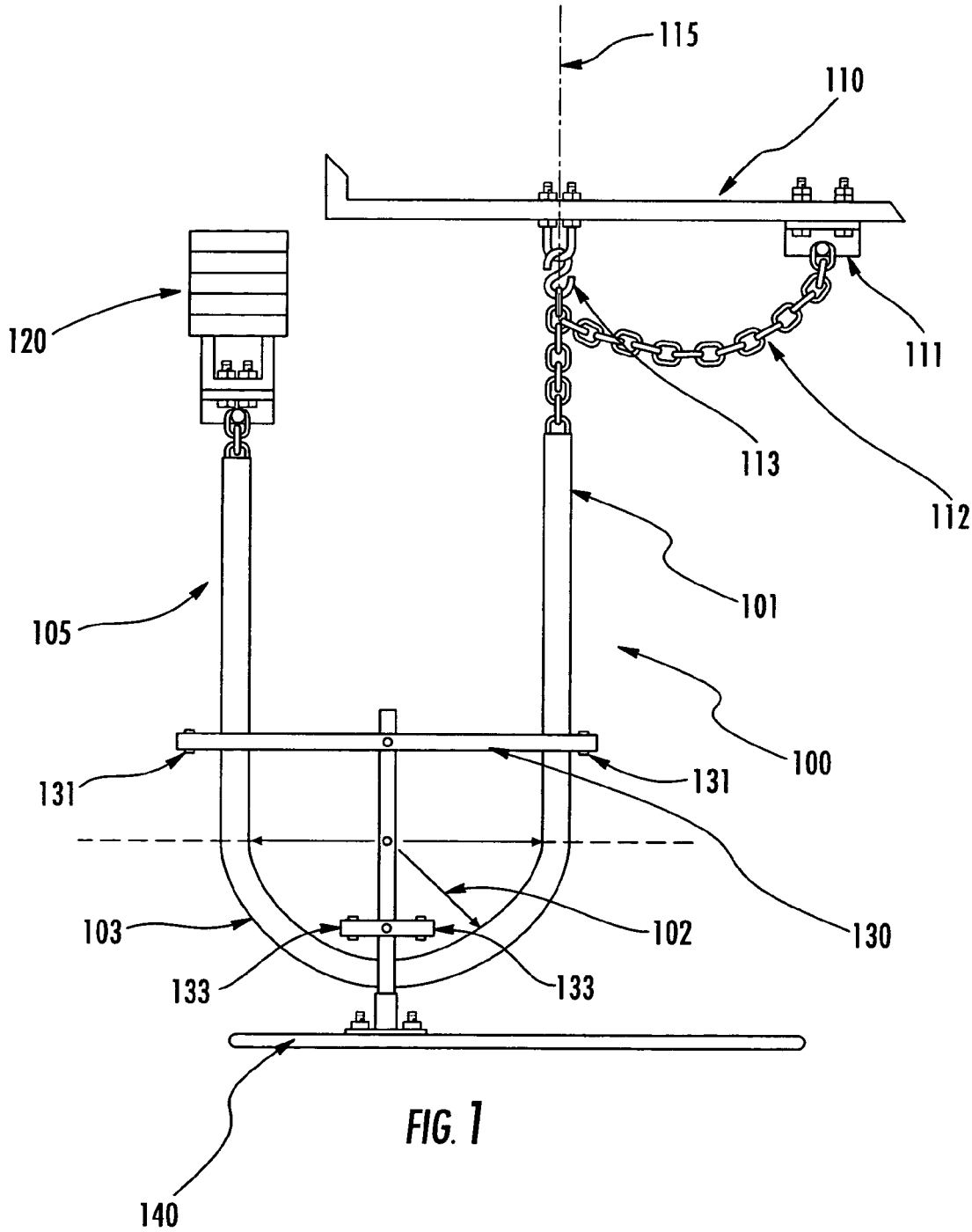

| | | | |
|---|---|---|---|
| 2003/0075389 | A1 | 4/2003 | Otsuka et al. |

FOREIGN PATENT DOCUMENTS

| | | | |
|---|---|---|---|
| GB | 1 286 937 | A | 8/1972 |
| GB | 1286937 | | 8/1972 |
| JP | 55 094045 | A | 7/1980 |
| JP | 55094045 | | 7/1980 |
| WO | 2004076323 | A1 | 9/2004 |
| WO | WO 2004/076323 | A | 9/2004 |

* cited by examiner

ELEVATOR COMPENSATING CABLE HAVING A SELECTED LOOP RADIUS AND ASSOCIATED SYSTEM AND METHOD

BACKGROUND OF THE INVENTION

1. Field of the Invention

The present invention relates to an elevator having a compensating cable and, more particularly, to a compensating cable having specific flexibility characteristics selected such that the compensating cable is capable of attaching to an elevator car at a centerline such that the elevator car, and a load carried thereby, is more effectively balanced when the elevator is in operation.

2. Description of Related Art

An elevator car installation typically uses a compensating cable arrangement, as will be appreciated by one skilled in the art. Such a compensating cable is generally flexible and can be hung at very long lengths in an elevator hoistway. Because the compensating cable is attached to the elevator car and a counterweight, which move vertically and opposite each other, the cable defines an arcuate loop at the lower portion of the elevator hoistway that connects a first portion attached to the elevator car and a second portion attached to the adjacent counterweight. In conventional compensating cable arrangements, the arcuate loop of the cable defines a relatively small diameter such that the first portion of the cable attaches to the elevator car at an off-center position (often at a position nearest the counterweight in the hoistway) on a lower portion of the elevator car. Thus, in conventional elevator systems, the weight of the compensating cable produces a substantial off-center force on the lower portion of the elevator car, especially while the elevator car is located at higher locations within the hoistway (where the length and weight of the compensating cable is at a maximum).

In conventional elevator systems, the unbalanced weight force generated by the off-center attachment of the compensating cable to the elevator car is, in some systems, balanced by a car counterweight that may be attached to the side of the elevator car opposite the attachment point of the compensating cable. In addition, in other conventional systems, additional compensating cables may also be attached to the lower portion of the elevator car such that the overall force generated by the weight of the various compensating cables is generally balanced. While these systems are somewhat helpful in attaining and maintaining balance in the elevator car during its operation, these systems may also produce other problems, such as the need for a specialized damping or guide system to ensure that multiple compensating cables track properly and remain tangle-free as they travel through the hoistway during the operation of the elevator system. In addition, car counterweight systems in conventional elevator systems may not be fully effective for balancing the elevator car as it travels to the highest floors in the hoistway. For example, in conventional elevator systems, the weight of the compensating cable when the elevator is located at higher positions within the hoistway may overcome a balancing weight force provided by the car counterweight attached to the elevator car. Thus, when the elevator car is hoisted to the upper levels of the hoistway, the weight of the compensating cable may cause the elevator car to tilt slightly towards the counterweight. In a similar manner, when the elevator car is lowered to the lower portions of the hoistway, the weight of a car counterweight (in comparison to the relatively light/short portion of the compensating cable) may cause the elevator car to tilt slightly away from the counterweight. In all of the above-mentioned situations, the imbalances encountered by the elevator system will tend to cause more rapid wear on the components of the elevator system and/or require that the elevator system be serviced and balanced more often. Ultimately, these conditions adversely affect elevator ride quality.

Thus, there exists a need for a compensating cable that may be attached to an elevator car so as to reduce and/or minimize imbalances in an elevator system. Furthermore, there exits a need for a compensating cable having mechanical characteristics supporting an imbalance-minimizing configuration. There also exists a need for an elevator system including a compensating cable that provides improved balance to an elevator car and associated elevator system components so as to reduce costs, decrease wear, and facilitate the extension of the required maintenance intervals for the elevator system.

BRIEF SUMMARY OF THE INVENTION

The above and other needs are met by the present invention which, in one embodiment, provides a compensating cable adapted to be operably engaged with an elevator car having a lower side, wherein the lower side defines a centerline. More particularly, the compensating cable comprises a first portion adapted to be operably engaged with the lower side of the elevator car and a second portion adapted to be operably engaged with a counterweight positioned in an elevator hoistway. The compensating cable also comprises an arcuate portion disposed between the first and second portions (for example, at the bottom portion of the elevator hoistway). The arcuate portion defines a radius configured such that the first portion is configured to be capable of operably engaging the lower side of the elevator car at the centerline so that the elevator car may be substantially balanced about the centerline.

Another advantageous aspect of the present invention comprises an elevator system. Such a system includes an elevator car comprising a lower side, wherein the lower side defines a centerline, and a counterweight (disposed in an elevator hoistway, for instance). The elevator system also includes a compensating cable comprising a first portion operably engaged with the lower side of the elevator car, a second portion operably engaged with the counterweight, and an arcuate portion disposed between the first and second portions. As described above, the arcuate portion defines a selected radius such that the first portion operably engages the lower side of the elevator car at the centerline and/or centerline so as not to interfere with the car's balance.

Still another advantageous aspect of the present invention comprises a method for balancing an elevator car operably engaged with a compensating cable. As described above with respect to the cable and elevator system embodiments, the compensating cable includes a first portion and a second portion connected by an arcuate portion (that may be disposed at a bottom portion of an elevator hoistway). The method comprises the steps of forming the arcuate portion to define a radius configured to allow the first portion to operably engage a centerline of the bottom portion of the elevator car, so that the elevator car maintains substantial balance about the centerline.

Yet still other advantageous embodiments of the present invention comprise a compensating cable adapted to be operably engaged with an elevator car having a lower side, the lower side defining a centerline. More particularly, the compensating cable includes a cross-sectional structure comprising a core layer, a first sheath layer disposed about the core layer and comprising a first polymeric material having a first hardness, a second sheath layer disposed about the first sheath layer and comprising a second polymeric material having a second hardness, and a third sheath layer having a substantially circular outer cross-section and disposed about the second sheath layer, wherein the third sheath layer comprises a third polymeric material having a third hardness. Thus, the relative first, second, and third polymeric materials of the compensating cable may constrain the compensating cable to form an arcuate portion having a selected loop radius that may be configured such that the first portion of the compensating cable attaches to a balanced centerline located on the bottom portion of the elevator car. According to some alternative embodiments, the core layer may comprise proof chain, flexible wire rope, and/or other suitable core materials that may have sufficient strength to support the weight of the compensating cable hanging from the lower side of the elevator car. In addition, the sheath layers of the compensating cable may comprise, in some alternative embodiments, substantially stiff engineering polymers, such as polyvinyl chloride (PVC) or other materials having a selected hardness and/or other mechanical properties suitable for constraining the compensating cable to a selected (minimum) loop radius. According to some additional embodiments, the sheath layers may be embedded with a mixture of metallic, polymeric, or other particle types selected to impart selected mechanical properties to the sheath layers.

Thus the compensating cable, system, and methods for more effectively balancing an elevator car, as described in the embodiments of the present invention, provide many advantages that may include, but are not limited to: providing a substantially balanced weight distribution about a centerline of the elevator such that the elevator ride quality is substantially improved; reducing the wear burden and maintenance costs on elevator systems by reducing the instances of weight imbalances; reducing the cost and complexity of damping systems and static balance weights required by the elevator system to maintain balance and safe operation of the elevator car; reducing the incidence of tangles that may be more likely to occur in conventional elevator systems comprising compensating cables having smaller loop radii and correspondingly less-stiff mechanical properties; and providing a compensating cable structure and material composition that is suitable for producing a self-damping compensating cable that forms an arcuate portion having an increased loop radius that may be tailored to fit and balance an existing elevator system.

These advantages and others that will be evident to those skilled in the art are provided in the compensating cable, system, and method of the present invention.

BRIEF DESCRIPTION OF THE SEVERAL VIEWS OF THE DRAWING(S)

Figure 2:
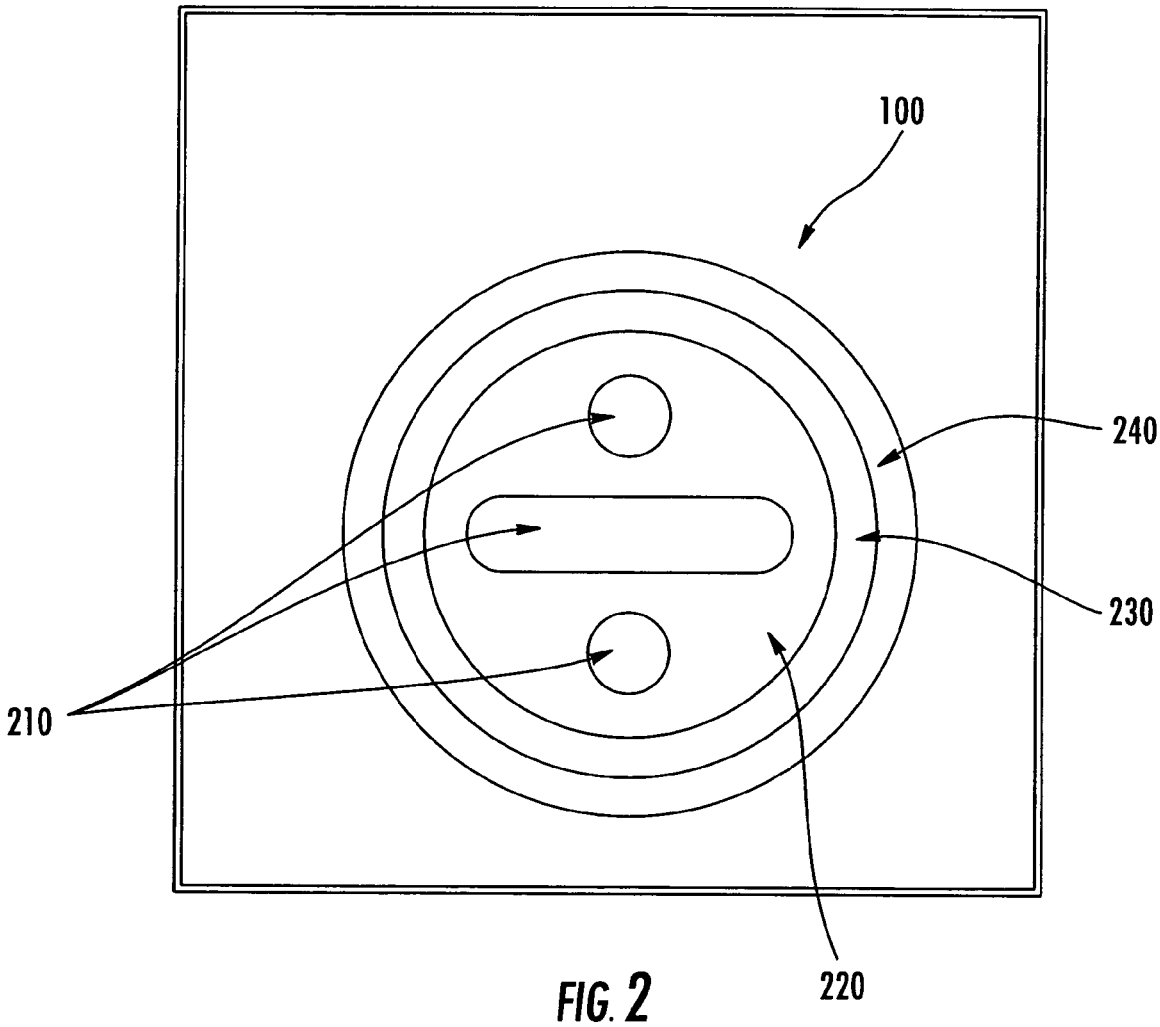

Having thus described the invention in general terms, reference will now be made to the accompanying drawings, which are not necessarily drawn to scale, and wherein:

FIG. 1 shows one example of an elevator system having a compensating cable according to one embodiment of the present invention; and FIG. 2 shows one example of the cross-sectional structure of a compensating cable according to one embodiment of the present invention.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

While the embodiments of the present invention are discussed below in relation to a compensating cable, system, and associated method including a compensating cable having an extended loop diameter such that the compensating cable may be operably engaged with a centerline of an elevator car, it should be understood that the cables, systems, and associated methods disclosed herein may also be used to produce a compensating cable having mechanical properties and resulting corresponding loop diameters that may be selected such that the compensating cable may be selectively operably engaged with the elevator car at a plurality of different points disposed on an exterior surface of the elevator car. In addition, as discussed more particularly below, the mechanical properties of the compensating cable of the present invention may be selectively modified (via the modification of cable structure and/or material composition) such that the compensating cable may be operably engaged with the centerlines of various elevator cars having a variety of sizes and configurations.

FIG. 1 illustrates an elevator system according to one embodiment of the present invention, including a compensating cable 100 operably engaged with both the centerline 115 of a bottom portion of an elevator car 110 and with a counterweight 120 that may be disposed in association with the elevator car 110 (in, for example, an elevator hoistway). The compensating cable 100 comprises a first portion 101 adapted to be operably engaged with the lower side of the elevator car 110 and a second portion 105 adapted to be operably engaged with a counterweight 120. The compensating cable also comprises an arcuate portion 103 disposed between the first and second portions 101, 105, the arcuate portion 103 defining a radius 102 configured such that the first portion 101 is configured to be capable of operably engaging the lower side of the elevator car 110 at the centerline 115 so that the elevator car 110 is substantially balanced about the centerline 115. The centerline 115 of the bottom of the elevator car 110 may be defined as the point of attachment for the first portion 101 wherein the weight force exerted by the compensation cable 100 on the elevator car 110 is most balanced, such as, for example, at the centerline 115 of the underside of an elevator car. For example, in elevator system embodiments comprising an elevator car 110 having a substantially symmetrical weight distribution about a substantially rectangular bottom portion, the centerline 115 may be approximately defined as the line that is parallel to the counterweight and substantially equidistant from the parallel sides of the bottom portion of the elevator car 110.

According to some embodiments, multiple compensating cables 100 may be operably engaged with the bottom portion (or underside) of an elevator car 110 along the centerline 115. Such compensating cables 100 may be attached at several equidistant points along the length of the centerline so as to not interfere with the elevator car's balance. In other embodiments, a single compensating cable 100 may be attached to a point on the centerline 115 of the bottom portion of the elevator car 110 at a point that is substantially equidistant from the parallel edges of the bottom portion of the elevator car that are intersected by the centerline 115.

One skilled in the art will appreciate that the counterweight 120 may be disposed in association with the elevator car 110 in an elevator hoistway such that the counterweight 110 may be positioned beside and/or behind the elevator car 110 such that the elevator car 110 and corresponding counterweight 120 may be raised and/or lowered freely during the operation of the elevator system. Thus, in embodiments of the elevator system where the counterweight 120 is positioned beside the elevator car 110 (or beside the vertical pathway thereof) the arcuate portion 103 of the compensating cable may extend from a point directly below the centerline 115 of the bottom portion of the elevator car 110 to a position to the side of the elevator car 110 (or a vertical pathway thereof) as shown generally in FIG. 1. Furthermore, in embodiments where the counterweight 120 is positioned behind the elevator car 110, the arcuate portion 103 may extend from a point directly below the centerline 115 to a position behind the elevator car 110. In addition, the structure, materials, and cross-sectional design (see, for example FIG. 2) of the compensating cable 100 may be selectively adjusted as described in further detail below, such that the loop radius 102 attainable by the arcuate portion 103 of the compensating cable 100 may be set to a selected minimum radius such that the first portion 101 of the compensating cable 100 may operably engage the centerline 115 of the bottom portion of the elevator car 110. Therefore, embodiments of the present invention, may allow the loop radius 102 of the compensating cable 100 to be designed for the particular dimensions of the elevator car 110 to which the cable 100 may be attached regardless of the relative positions, distances, and/or other geometric constraints presented by various elevator systems. For example, the compensating cable 100 may be appropriately configured such that the minimum loop radius 102 of the compensating cable 100 corresponds to half the distance between the centerline 115 and the point of attachment to the counterweight 120. As a result, some embodiments of the compensating cable 100 of the present invention may be retrofitted into existing elevator systems wherein conventional compensation cables once created balance issues due to the need to attach the cable at a point somewhat distant from the centerline 115.

FIG. 2 shows a cross-section of the compensating cable 100 according to one advantageous embodiment of the present invention wherein the structure and materials of the compensating cable 100 are selected such that the arcuate portion 103 formed by the compensating cable exhibits an expanded or larger minimum loop radius 102 such that the first portion 101 of the compensating cable 100 operably engages the centerline 115 of the bottom portion of the elevator car 110 as described above with respect to FIG. 1. In addition, according to some embodiments, the structure and materials of the compensating cable 100 may be configured such that the compensating cable 103 forms a catenary portion when suspended from the centerline 115 of the bottom portion of the elevator car. According to one embodiment, (shown generally in FIG. 2, the compensating cable 100 comprises a core layer 210 of a chain comprised of, for example, a durable metallic material such as stainless steel or another steel alloy suitable for the weight loads of the compensating cable 100 extending downward from the attachment points at the elevator car 110 and counterweight 120. In other embodiments, the core layer 210 may comprise proof coil chain, stranded metal wire rope, high tensile strength nylons and aramid fibers, or other materials suitable for use as a core material of the compensating cable 110. The compensating cable also comprises a first sheath layer 220 disposed about the core layer 210 and comprising a first polymeric material having a first hardness. The first polymeric material may comprise various polymers suitable for encasing and/or filling voids about the core layer 210 such that the core layer is covered and presents a substantially uniform outer surface having a substantially round cross-section (as shown generally in FIG. 2). Furthermore, the compensating cable also comprises a second sheath layer 230 disposed about the first sheath layer 220 (and the core layer 210 enclosed therein). The second sheath layer 230 may, in some embodiments, comprise a second polymeric material having a second hardness. Finally, the compensating cable 100 cross-sectional structure also comprises a third sheath layer 240 having a substantially circular outer cross-section and disposed about the second sheath layer 230. The third sheath layer 240 comprises a third polymeric material having a third hardness, such that the relative first, second, and third polymeric materials enable the compensating cable 100, when bent about a 180 degree turn (as at the bottom of an elevator system hoistway, shown generally in FIG. 1) to form an arcuate portion 103 having a selected minimum loop radius 102 defined such that the first portion 101 of the compensating cable 100 may operably engage a centerline 115 located on the bottom portion of the elevator car 110 such that the weight force exerted by the compensating cable 100 on the elevator car 110 may be substantially balanced with regard to the centerline 115 (as discussed above with regard to the elevator system embodiment shown in FIG. 1). According to various embodiments, the first, second, and/or third polymeric materials may comprise polyethylene (PE), polyvinylchloride (PVC), polyolefin, rubber, polyamides, polyurethane, and/or combinations thereof. Furthermore, according to some embodiments, the first, second, and/or third sheath layers may be composed of first, second, and third polymeric materials respectively that are embedded with a mixture of particles in order to modify and/or refine the mechanical characteristics of the sheath layers. The embedded particles may include, for example, ferrous or non-ferrous metallic particles or other particles chosen to impart a selected mechanical characteristic to the sheath layers. In some embodiments, the first, second and third sheath layers may not exhibit substantially different hardness levels. In other embodiments, the polymeric materials making up the sheath layers may exhibit one, two, and/or three different hardness levels in order to generate a compensating cable 100 structure that exhibits a selected loop radius 102.

According to one advantageous embodiment, each of the first, second, and third sheath layers 220, 230, 240 may all comprise a polymeric material such as polyvinyl chloride (PVC) having a durability and surface finish suitable for withstanding the repeated bending cycles associated with forming the arcuate portion 103 of the compensating cable 100 at, for example, the bottom portion of an elevator hoistway. In addition, the PVC material utilized in such an embodiment may exhibit a hardness that is substantially greater than that of other polymeric materials used in conventional compensating cables. The increased hardness of the sheath layers 220, 230, 240 described above with respect to this embodiment, may thus restrict the formation of an arcuate portion 103 (in the compensating cable 100) exhibiting a loop radius 102 that is less than the minimum loop radius required to allow the first and second portions of the compensating cable to engage the centerline 115 of the elevator car 110 and the counterweight 120, respectively. In addition, the increased stiffness of the compensating cable 100 having sheath layers 220, 230, 240 which may all be composed of PVC, also increases the inherent ability of the compensating cable 100 of the present invention to resist and/or dampen vibrations, waves, and/or oscillations that may be introduced in the compensating cable 100 by shocks, tangles, imbalances, or other elevator system forces that may impact the stability of the compensating cable 110. Thus, some embodiments of the compensating cable 100 of the present invention may provide a distinct advantage over conventional elevator systems in that the stiffness and other specified mechanical properties of the compensating cable 100 recited herein may reduce and/or obviate the need for separate damping systems that may be conventionally used to guide and/or dampen oscillations in compensating cables 100 of elevator systems.

In addition, in some embodiments, the relative thicknesses of the sheath layers 220, 230, 240 and/or the overall outer diameter of the compensating cable (as shown generally in FIG. 2) may be selected in order to constrain the compensating cable 100 to form a minimum loop radius 102 having a selected dimension. Generally, compensating cable 100 having a larger overall outer diameter will be constrained to a larger minimum loop radius 102. For example, a compensating cable 100 having the general configuration shown in FIG. 2, wherein the sheath layers 220, 230, 240 are all composed of PVC having the same or similar hardness levels, an overall cable outer diameter of 1.3 inches will yield a compensating cable having a loop radius of about 12 inches. Similarly, a compensating cable of the same overall characteristics, but having an outer diameter of about 2 inches will yield a compensating cable having a loop radius of about 14 inches.

According to some embodiments, alternative materials may be used to form the first, second, and third sheath layers 220, 230, 240 of the compensating cable 100 in order to alter the overall bending stiffness of the compensating cable 100. Thus, the loop radius 102 through which the arcuate portion 103 of the compensating cable 100 may extend may be selectively adjusted in the various embodiments of the present invention by, for example, selecting a mix of sheath materials 220, 230, 240 (having corresponding hardness levels, relative thicknesses, and/or other suitable mechanical properties) that provide the compensating cable 100 with an overall bending stiffness suitable for attaining a selected loop radius 102. For example, according to one embodiment, the first, second and third sheath layers 220, 230, 240 may be composed of PVC having a hardness level of 84 on the Shore A hardness scale in order to produce a compensating cable 100 that is constrained to form an arcuate portion having a loop radius 102 no greater than 24 inches. Thus, in this example, the compensating cable 100 may be suited to attach to the centerline of an elevator car 110 that is positioned 48 inches from the adjacent counterweight. Furthermore, the stiffness constraints of the compensating cable 100 (introduced, for example, by the choice of sheath materials 220, 230, 240) may also reduce the incidence of oscillations, vibrations, or other disturbances in the compensating cable 110 that may cause damage and/or ride instability in an elevator system such that the compensating cable is substantially and/or partially self-damping such that the elevator system embodiments of the present invention may, in some examples, require no additional damping equipment (such as the damping device 130 shown generally in FIG. 1).

As shown generally in FIG. 1, the sheath layers 220, 230, 240 may extend over all or only some portion of the core layer 210 of the compensating cable 100. For example, as shown in FIG. 1, the sheath layers 220. 230, 240 may extend over a majority of the length of the first and second portions 101, 105 and be omitted at the terminal points of these portions 101, 105 in order to expose the core layer 210 (which may comprise a cable, proof chain, or other material as discussed above) such that the core layer 210 may be more easily attached to the counterweight 120 and the centerline 115 of the elevator car 110. The sheath materials 220, 230, 240, however, may, in some embodiments, extend over the majority of the length of the compensating cable 100 such that the sheath materials 220, 230, 240 may effectively define the minimum loop radius 102 that may be formed in the arcuate portion 103 of the compensation cable 100. For example, referring to FIG. 1, as the elevator ascends, the second portion 105 of the compensating cable 100 will shorten and the first portion 101 will correspondingly lengthen as the substantially fixed-length compensation cable 100 forms the loop radius 102 at the bottom portion of the elevator hoistway. Further, as the elevator car 110 descends, the opposite condition will exist wherein the first portion 101 will shorten in relation to the second portion 105. Thus, in some embodiments, the sheath layers 220, 230, 240 should extend over a majority of the length of the compensating cable 100 in order to ensure that the loop radius 102 remains constrained to a selected radius distance throughout the range of travel of the elevator system such that the weight of the compensating cable 100 remains substantially balanced with respect to the centerline of the elevator car 110 regardless of the elevator car 110 position within the elevator system.

In addition, as shown generally in FIG. 1, the elevator system of the present invention may also, in some embodiments, comprise a safety loop 112 incorporated into the first portion 101 of the compensating cable 100 (which may, as shown in FIG. 1 comprise a portion of the compensating cable 100 having an exposed core layer 210, such as a proof chain). The safety loop 112 may be, for example, located underneath the elevator car 110 where a loop 112 of the compensating cable 100 is supported from the car with a deformable S-hook 113. The S-hook 113 functions as a mechanical safety link such that, should the compensating cable 100 become entangled and/or overloaded, the S-hook 113 yields and the slack or excess length of cable forming the loop 112 is released from the elevator car 110 while the compensating cable 100 still remains attached to the elevator car 110 via an off-center attachment point 111. One intended effect of such a configuration is that the released excess cable 100 will allow the cable to untangle itself, thereby reducing the risk of damage to the cable 100 should it become severely overloaded. The increased stiffness and increased loop radius 102 of the compensating cable 100 of the present invention, however, may reduce the incidence of tangles that may be more likely to occur in conventional elevator systems comprising compensating cables having smaller loop radii and correspondingly less-stiff mechanical properties.

While the increased stiffness of the compensating cable 100 embodiments of the present invention may exhibit self-damping characteristics (as described above), some embodiments of the elevator system of the present invention may also comprise a damping device 130 (as shown generally in FIG. 1) for further reducing and/or minimizing oscillations, cable sway, and/or vibrations within the compensating cable 100. In addition, the damping device 130 may also aid in guiding the compensating cable 100 through the 180 degree bend (defining the arcuate portion 103 of the cable 100) that is required at the bottom portion of the elevator hoistway. As shown generally in FIG. 1, the damping device 130 may, in some instances, comprise a pair of upper rollers 131 disposed outside first and second portions 101, 105 of the cable 100 as well as a pair of lower rollers 133 disposed between the first and second portions 101, 105 of the cable 100 and just above the arcuate portion 103 of the cable 100. Thus, the damping device 130 may, in some embodiments, be provided to guide the compensating cable 100 as it forms the arcuate portion 103 at the bottom portion of the hoistway. The damping device may comprise, for example, a damping device 130 such as the device disclosed in U.S. patent application Ser. No. 10/915,245 entitled Dampening Device for an Elevator Compensating Cable and Associated System and Method, which is herein incorporated by reference in its entirety. In addition, other damping devices 130 may also be used in conjunction with the embodiments of the present invention in order to lessen and/or minimize compensating cable 100 sway and/or oscillation at relatively high elevator car 110 speeds (such as, for example, speeds above 350 feet/minute).

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A compensating cable adapted to be operably engaged with an elevator car, the compensating cable comprising: a core layer; a first sheath layer disposed about the core layer and comprising a first polymeric material having a first hardness; a second sheath layer disposed about the first sheath layer and comprising a second polymeric material having a second hardness; and a third sheath layer having a substantially circular outer cross-section and disposed about the second sheath layer, the third sheath layer comprising a third polymeric material having a third hardness, such that the relative first, second, and third polymeric materials of the compensating cable cause the compensating cable to form a substantially catenary arcuate portion having a radius no greater than a selected maximum loop radius; wherein the first, second, and third hardnesses are substantially equivalent; and wherein the first, second, and third polymeric materials comprise PVC and the first, second, and third hard nesses are about 84 Shore A.

* * * * *

UNITED STATES PATENT AND TRADEMARK OFFICE

CERTIFICATE OF CORRECTION

PATENT NO. : 7,610,994 B2
APPLICATION NO. : 11/128471
DATED : November 3, 2009
INVENTOR(S) : Green It is certified that error appears in the above-identified patent and that said Letters Patent is hereby corrected as shown below:

Column 10

Line 15, “hard nesses” should read --hardnesses--

Signed and Sealed this
Eighth Day of February, 2011

David J. Kappos

David J. Kappos
*Director of the United States Patent and Trademark Office*